US006318474B1

(12) United States Patent
Sundholm

(10) Patent No.: US 6,318,474 B1
(45) Date of Patent: Nov. 20, 2001

(54) SPRAY HEAD

(76) Inventor: Göran Sundholm, Ilmari Kiannon kuja 3, FIN-04310 Tuusula (FI)

( * ) Notice: Subject to any disclaimer, the term of this patent is extended or adjusted under 35 U.S.C. 154(b) by 0 days.

(21) Appl. No.: 09/499,327

(22) Filed: Feb. 4, 2000

(30) Foreign Application Priority Data

Dec. 22, 1999 (FI) ..... 992765

(51) Int. Cl.[7] ..... A62C 37/08
(52) U.S. Cl. ..... 169/37; 239/558
(58) Field of Search ..... 169/37; 239/553, 239/553.3, 553.5, 558, 559, 590.5, 589

(56) References Cited

U.S. PATENT DOCUMENTS

| | | | | |
|---|---|---|---|---|
| 2,813,753 | * | 11/1957 | Roberts | 239/558 |
| 4,032,300 | * | 6/1977 | Parker et al. | 239/558 X |
| 4,151,958 | | 5/1979 | Hofmann | 239/533.3 |
| 5,485,961 | | 1/1996 | Reitzig | 239/558 |
| 5,617,922 | * | 4/1997 | Sundholm | 169/37 |
| 5,944,113 | | 8/1999 | Sundholm | 169/37 |

FOREIGN PATENT DOCUMENTS

| | | |
|---|---|---|
| 19907355 | 9/2000 | (DE) . |
| 2178342 | 2/1987 | (GB) . |
| 9215370 | 9/1992 | (WO) . |
| 9502433 | 1/1995 | (WO) . |
| 9601666 | 1/1996 | (WO) . |
| 9804322 | 2/1998 | (WO) . |

* cited by examiner

*Primary Examiner*—Lesley D. Morris
(74) *Attorney, Agent, or Firm*—Ladas & Parry

(57) ABSTRACT

The invention relates to a spray head, preferably for extinguishing fire, comprising a frame (1""), an inlet (2"") and a passage (7""*a*, 7"") leading to at least one nozzle (6""*a*, 6""*b*) with an opening (3""*a*) including a first boring (4""*a*, 4""*b*) and a second boring (5""*a*, 5""*b*), the first boring comprising a first diameter and the second boring a second diameter. In order for the spray head to have a good efficiency and a very simple construction and to be able to deliver medium in the form of mist, the spray head is characterized in that the first boring (4""*a*, 4""*b*) comprises a diameter that is 0.1 to 0.9 times the diameter of the second boring (5'*a*, 5'*b*, 5'*c*), that the length of the first boring is 0.25 to 15 times the diameter of the first boring, and that the length of the second boring is approximately 0.25 to 15 times the diameter of the second boring.

24 Claims, 3 Drawing Sheets

SPRAY HEAD

BACKGROUND OF THE INVENTION

The invention relates to a spray head, preferably for extinguishing fire, comprising a frame, an inlet and a passage leading to at least one nozzle with an opening including a first boring and a second boring, the first boring comprising a first diameter and the second boring a second diameter. The spray head nozzle is, when driven, intended to provide mist, i.e. small droplets when a particular pressure is exerted in the nozzle.

Similar spray heads are known in the art. For example, U.S. Pat. No. 5,944,113 discloses such a spray head.

In order to be able to spray mist with small droplets from known nozzles, the known spray head nozzles comprise openings into which various mechanical obstacles are arranged. Such a mechanical obstacle may be, for example, a rotating body, a stationary particularly shaped locking part, a helical spring etc.

When similar obstacles are used a considerable drawback is that they reduce the efficiency of the spray head. This means that a fairly high effect is needed to provide a desired type of spray.

Said obstacles in the nozzles also mean that the structure of the nozzles and spray heads become fairly complicated. The nozzles are difficult to produce and they are supported in specific nozzle housings mounted into the frame of the spray head. Consequently the production costs of the spray head increase.

BRIEF DESCRIPTION OF THE INVENTION

The present invention relates to a spray head which can be produced very economically and does not comprise said drawbacks and which despite the drawbacks is able to spray fine mist from its nozzle or nozzles.

In order to achieve said object the spray head of the invention is characterized in that the first boring has a diameter that is 0.1 to 0.9 times the diameter of the second boring, that the length of the first boring is 0.25 to 15 times the diameter of the first boring, and that the length of the second boring is approximately 0.25 to 15 times the diameter of the second boring.

According to a preferred embodiment the diameter of the first boring is approximately 0.3 to 5 mm. The diameter of the second boring is preferably not more than about 50 mm. As for the formation of mist a particularly advantageous effect is obtained by arranging the first boring at an angle in relation to the medium flow in the main channel of the nozzle. A wider angle generally provides mist with smaller droplets, i.e. a better result in view of the mist formation.

The invention is based on the astounding observation that mist including very small droplets can be produced without having to place mechanical obstacles into the nozzle/nozzles of the spray head, when the nozzles are dimensioned as indicated in the attached claims. In order to produce the mist, a high pressure is not necessarily needed but the mist can be produced with a relatively low pressure, typically from about 10 bar upwards. The medium is immediately composed of very small droplets as it flows out of the nozzle.

An essential advantage of the spray head is that it comprises a high efficiency, whereby a fairly low effect is sufficient for producing a mist-like spray with very small droplets. This means that a fire extinguishing installation provided with the spray heads of the invention may comprise a drive source and additional components which are smaller and considerably less expensive than the ones known. This is particularly important in surroundings where a limited and fairly minimal effect is available. Another essential advantage is that the construction of the spray head can be very simple. The number of components in the spray head can be drastically reduced. For example, in a sprinkler with a slidable spindle and a few nozzles and a heat-releasing ampoule, the number of components can be reduced from approximately 40 to 8 without having any negative effects on the function and safety of the spray head. In its simplest form the spray head may consist of only a single part. The structure of the spray head frame may be particularly simple and separate nozzles from the frame are not needed. The fact that no nozzles are needed means that the production costs for the spray head remain considerably lower than for the known spray heads providing mist.

BRIEF DESCRIPTION OF THE DRAWING

In the following the invention is described in greater detail with reference to the attached drawing, in which.

DETAILED DESCRIPTION OF THE INVENTION

Figure 1:
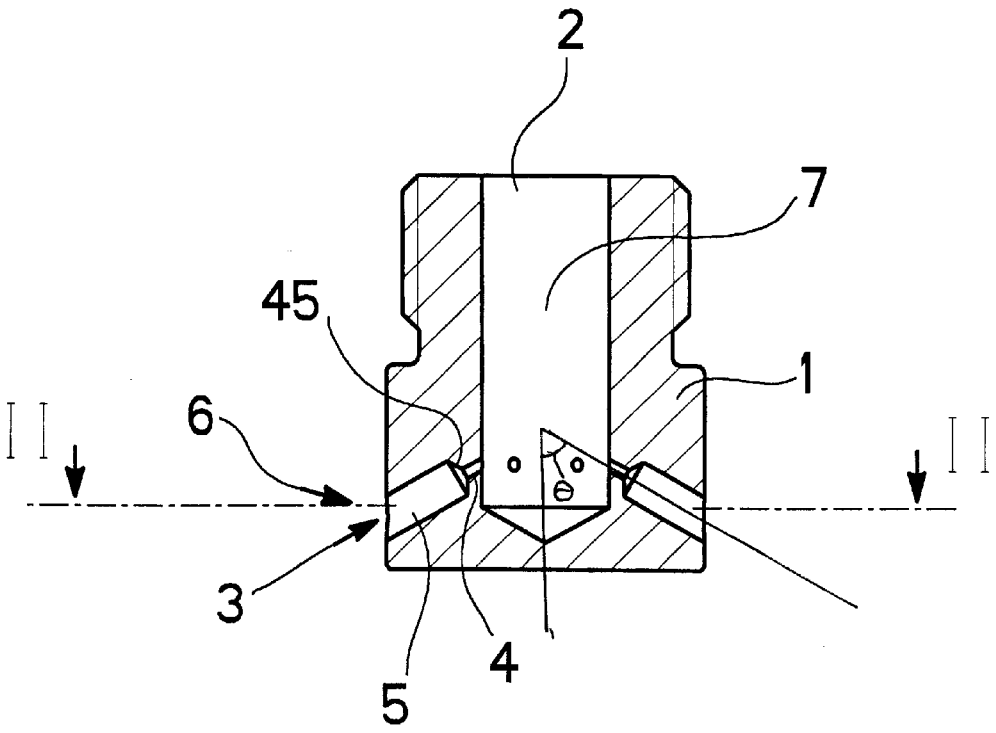
FIG. 1 is a side view showing a first preferred embodiment of the spray head of the invention.
Figure 2:
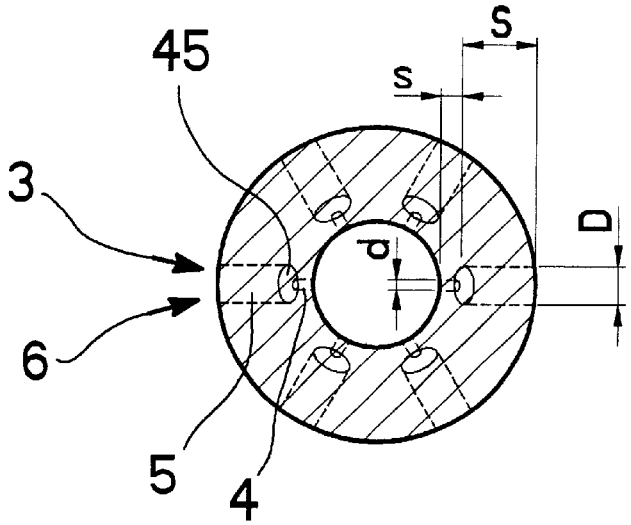
FIG. 2 is a cross-section showing the spray head in FIG. 1 following line II—II in FIG. 1.

FIGS. 1 and 2 is a cross-sectional side view, and a sectional top view respectively, showing a spray head of the invention. The spray head comprises a frame 1 with an inlet 2. A main channel of the spray head is indicated by reference numeral 7. Six identical openings 3 comprising a first boring 4 and a substantially aligned, longer second boring 5 are bored in the frame 1. These borings 4, 5 form the nozzles 6 of the spray head.

The length s of the first boring 4 is 0.25 to 15 times the diameter d of the first boring. Preferably s is 0.5 to 10 and most preferably 1 to 5 times d, in which case a high efficiency is obtained.

The first boring 4 has a smaller diameter d than the diameter D of the second boring. The diameter d is 10 to 90% of D. Preferably the diameter d is 10 to 80% of D and most preferably 20 to 70% of D. The diameter d is preferably within the range of 0.5 to 2.5 mm and most preferably within 0.5 to 1.5 mm. A diameter interval typically ranging from about 0.3 to about 5 mm can still be considered to provide good results, but when the diameter d remains beneath about 0.3 mm there is a risk of the jet being blocked by dirt etc. A large diameter d renders the mist formation more difficult if the pressure in the nozzle is not high. A large diameter d in combination with a preferably low pressure does typically not provide mist as a result.

The length S of the second boring 5 is about 0.25 to about 15, and preferably 0.5 to 10 times the diameter D thereof. A particularly good result is obtained when S is 1 to 5 times D. When the diameter D of the second boring 5 is about 50 mm at the most, a good result is obtained for most applications. However, exceptionally the diameter D may exceed 50 mm.

FIG. 1 shows that the direction of the openings 3 is at an angle in relation to the main channel 7 of the spray head. This means that the medium flow, for example the flow of water-based extinguishing medium, in the boring 4 is at an angle θ in relation to the direction of the medium flow in the main channel 7. The angle θ is preferably between 0 and 90 degrees and most preferably 10 to 80 degrees, but may be up to approximately 120 degrees for some applications. The wider the angle θ the better the mist formation, but the penetration is reduced.

Figure 3:
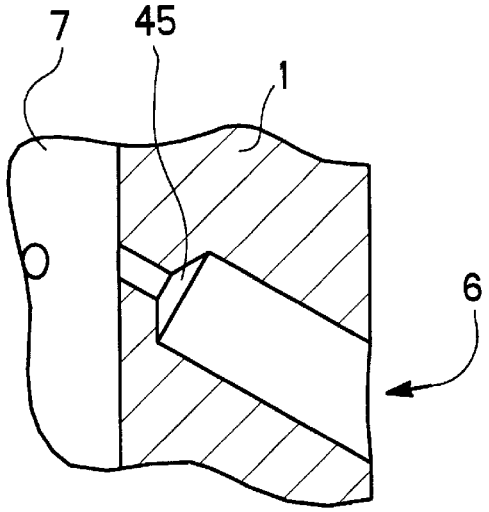
FIG. 3 shows an enlarged detail of the spray head in FIG. 1, FIGS. 4 to 6 show a second, third and fourth preferred embodiment of the spray head of the invention, FIG. 7 show a fifth preferred embodiment of the spray head of the invention in an inactive position.

FIG. 3 is an enlarged view of the nozzle 6 in FIG. 1.

Figure 4:
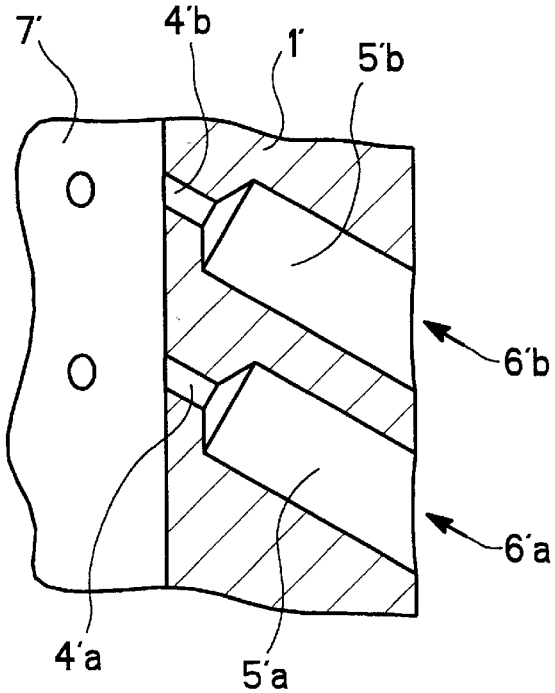

FIG. 4 illustrates another preferred embodiment of a spray head of the invention. The embodiment deviates from the one in FIG. 1 by a further nozzle 6'*b* being arranged above the nozzle 6'*a* (which can be considered to correspond with the nozzle 6). The geometry and the dimensioning of the nozzle 6'*b* correspond with those previously provided for the nozzles 6'*a* and 6. The nozzles 6'*b* and 6'*a* are parallel or may be diverging up to 45 degrees. An advantage with the further nozzle 6'b is that it substantially improves the penetration in comparison with a situation where no such further nozzle is present. The penetration improves (becomes stronger) because the mist-like sprays from the nozzles 6'*a* and 6 are sucked against each other, and a uniform forceful mist spray is obtained.

Figure 5:
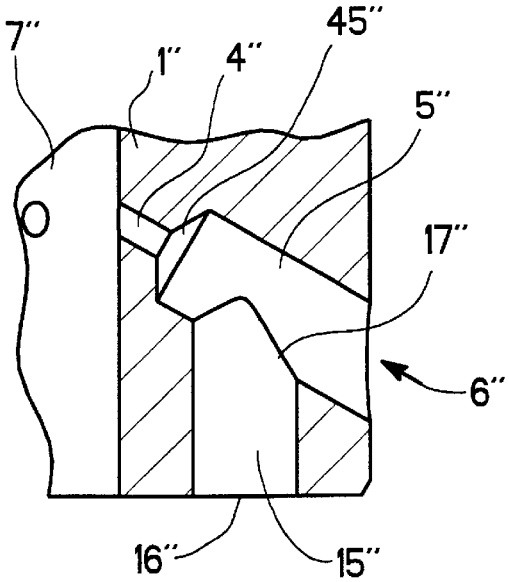

FIG. 5 illustrates a third embodiment of a spray head of the invention. The embodiment deviates from the one in FIG. 1 by comprising an air channel 15" that leads from an opening 16" in the frame to the second boring 5". The air channel 15" ends up in the boring 5" by means of an opening 17". The opening 17" of the air channel 15" is close to a transition 45" between the first and the second borings. The diameter of the air channel 15" is, for example, 0.5 to 1.5 times the diameter of the second boring 5". The air channel 15" considerably improves the penetration of the mist spray from the nozzle 6". The air channel does not, however, considerably affect the droplet size in the mist. In the Figure the air channel 15" is vertically directed downwards, but can be considered to be directed in other ways in relation to the main direction (spray direction) of the nozzle 6"; the opening should, however, be an opening which is in contact with air (or gas) outside the spray head. The air channel 15" can also be considered to extend upwards from the boring 5".

Figure 6:
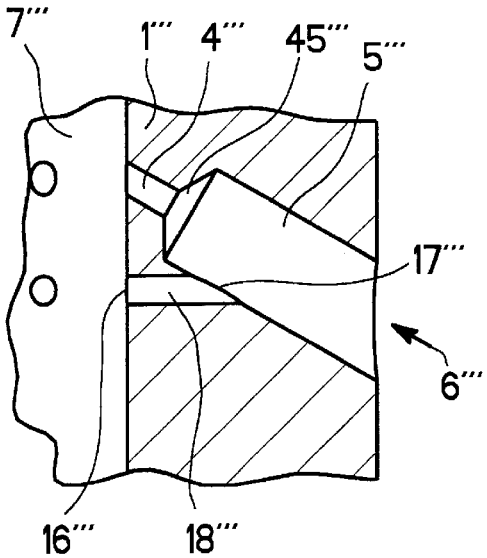

FIG. 6 illustrates a fourth preferred embodiment of a spray head of the invention. The embodiment deviates from the one in FIG. 1 by comprising a liquid channel 18'" that extends from an opening 17'" in the wall of the boring 5'" to an opening 16'" in the passage 7'" . The liquid channel 18" ends up in the boring 15" by means of an opening 17". The opening 17'" of the liquid channel 18" is close to the transition 45'" between the first and the second borings but need not be positioned there. The diameter of the liquid channel 18'" is, for example, 0.5 to 1.5 times the diameter of the first boring 4'". The liquid channel 18'" considerably improves the penetration of the mist spray from the nozzle 6'" . However, the liquid channel does not really affect the drop size of the mist. In the Figure the liquid channel 18'" is vertical but can also be considered to be placed at different angles in relation to the main direction (spray direction) of the nozzle 6'"; the opening 16'" should, however, have a fluid connection with the passage 7'" . The liquid channel 18'" can also be considered to extend upwards from the boring 5'".

Figure 7:
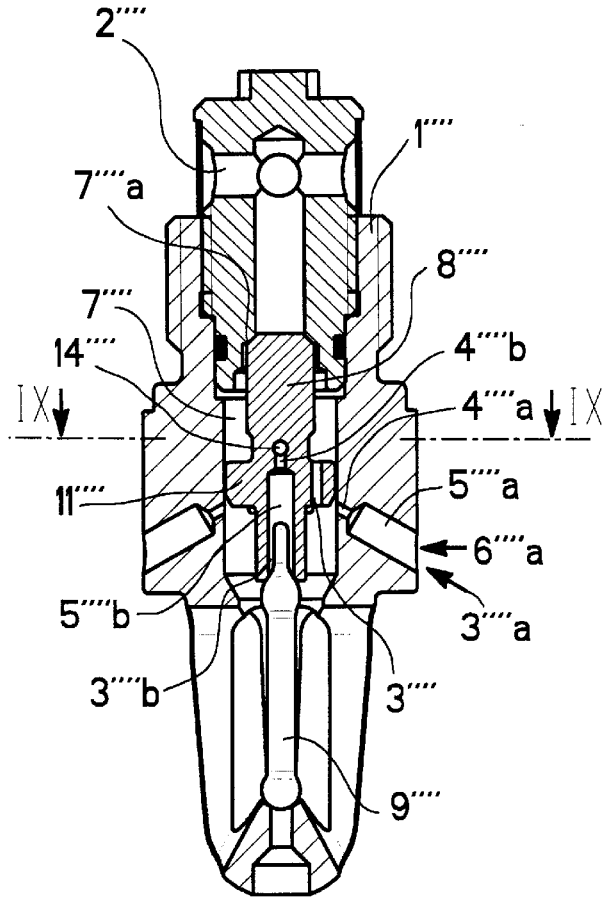
Figure 8:
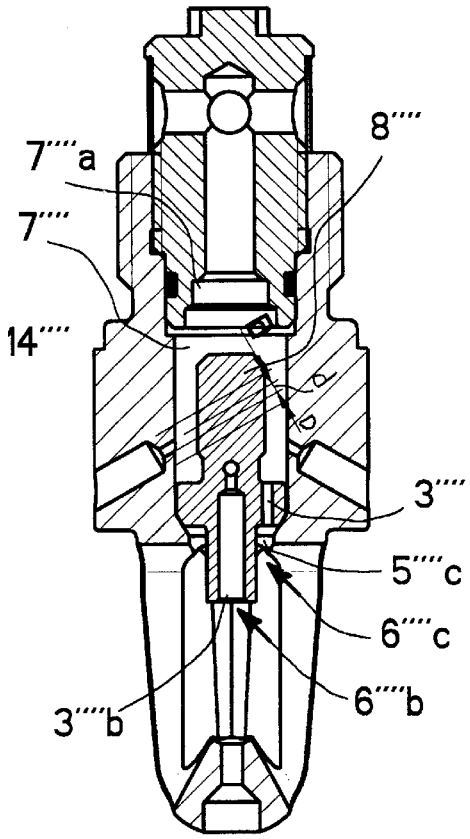
FIG. 8 shows the spray head in FIG. 7 in an active position.
Figure 9:
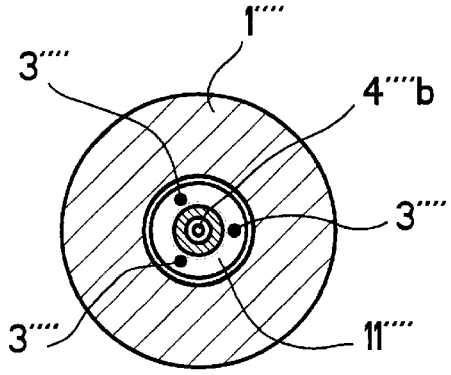
FIG. 9 is a cross-section showing the spray head in FIG. 7 following line IX—IX in FIG. 3.

FIGS. 7 to 9 show a sixth preferred embodiment of a spray head of the invention. The spray head comprises an inlet 2"", a frame 1"" and a number of nozzles 6""*a*, 6""*b*. The structure and the dimensioning of the nozzles 6""*a*, 6""*b* correspond with those of the nozzles 6"" in FIG. 1. The same measurements therefore hold true for the borings 4"" and 5"" as for the borings 4 and 5. The preferred embodiment in FIGS. 7 to 9 deviates from the one in FIG. 1 and 2 by the spray head comprising a spindle 8"" and a release means 9"" that explodes or melts in heat, for example, a glass ampoule. In this case, a sprinkler is concerned, owing to the release means 9"".

The spindle 8"" is slidably arranged in an air channel 7"" in the nozzle frame 1"". In FIG. 7 the sprinkler is in a standby mode. The glass ampoule 9"" is intact and the spindle 8"" closes a channel 7""*a* between the inlet 2"" and the main channel 7"". The spindle 8"" comprises a channel 14"" that leads to a nozzle 6""*b* at the lower end of the sprinkler. The channel 14"" connects the nozzle 6""*b* with the main channel 7"". A connection between the channel 14"" and the inlet 2"" does not exist when the sprinkler is in the standby mode; the connection is opened when the spindle slides down into the position shown in FIG. 8. The geometry of the nozzle 6""*b* is similar to the one of nozzle 6""*a*; the dimensions are only slightly smaller. Therefore the internal geometry and dimensioning of the borings 4""*b* and 5""*b* are identical to those of the borings 4""*a* and 5""*a*. The ampoule 9"" is supported at the top against the nozzle 6""*b*.

The spindle 8"" comprises a wider piston-like portion 11"" that supports the piston on the channel 7"". The piston-like portion 11"" comprises three through bores 3"". When the spray head is in the position shown in Figure 8, medium may flow from the inlet 2" through the borings 3"" towards the top of the spindle 8"" and out from the spray head. By means of the borings 3"" a favourable effect can be achieved on the penetration of the spray from the nozzle 6'"*b*.

If the ampoule 8"" in FIG. 7 explodes, the spindle 8"" slides into the position shown in FIG. 8 and the channel 7""a is opened. Here the connection between the inlet 2"" and the nozzles 6""*a*, 6""*b* and the boring 3"" remains open and extinguishing medium may flow from the nozzles. When the spindle 8"" is in the position shown in FIG. 8, a space 5""*c* is formed beneath the boring 3"" between the lower part of the spindle and the nozzle frame 1, said space having the same function as the borings 5""*a* and 5""*b*, i.e. the space 5""*c* allows a nozzle 6""*c* having the same structures and dimensioning as the nozzles 6'"*a* and 6""*b* to be formed. It is obvious that in the piston-like part 11"" borings having the same geometry as the borings 3""*a* and 3""*b*, i.e. borings comprising a boring with a larger diameter in addition to a boring with a smaller diameter, can be made instead of the borings 3"".

The embodiment in FIGS. 7 to 9 can preferably comprise nozzles according to FIGS. 4 to 6, i.e. nozzles arranged one after the other, or nozzles including an air channel or a liquid channel in order to improve the penetration.

FIGS. 1 and 3 to 7 clearly indicate that the transition between the first borings 4, 4'*a*, 4'*b*, 4", 4'", 4""*a*, 4""*b* and the second borings 5, 5'*a*, 5'*b*, 5", 5'", 5""*a*, 5""*b* in the openings 6, 6'*a*, 6'*b*, 6", 6'", 6""*a*, 6""*b* is beveled, cf. the transition 45 in FIG. 3, for example. The angle in the bevel may vary. It should also be observed that a bevel is not necessarily needed at all, in which case the angle and the transition from the smaller boring to the larger boring is 90 degrees.

The invention has above been described only with reference to examples. It is therefore pointed out that the details of the invention may deviate within the scope of the attached claims in many ways from the examples. In accordance with this the borings of the nozzles do not have to be cylindrical and do not have to be integrated into the same component (typically into the frame of the spray head) even though this is to be preferred considering the production of the nozzles. The nozzles 6""*a* and 6""*b* may alternate, meaning that either nozzles 6""*a* or nozzles 6""*b* can be missing. The number of the nozzles may also vary.

What is claimed is:

1. In a spray head for producing a mist, the improvements comprising a frame, an inlet and a main channel leading from the inlet to at least one nozzle with an opening including a first boring and a second boring, the first boring comprising a first diameter and the second boring comprising a second diameter, wherein the first diameter is 0.1 to 0.9 times the second diameter, the length of the first boring is 0.25 to 15 times the first diameter, and the length of the second boring is approximately 1 to 15 times the second diameter, wherein the first boring is at least substantially aligned with the second boring and the borings are at an angle in relation to the main channel.

2. A spray head as claimed in claim 1, wherein the diameter of the second boring is not more than about 50 mm.

3. A spray head as claimed in claim 1, wherein the diameter of the first boring is about 0.3 to about 5 mm.

4. A spray head as claimed in claim 1, wherein there is no boring with a diameter smaller than the second diameter in the nozzle downstream of the second boring.

5. A spray head as claimed in claim 1, wherein the walls of said borings are integral with the frame.

6. A spray head as claimed in claim 5, wherein said borings form the nozzle.

7. A spray head as claimed in claim 1, wherein the angle is 10 to 120 degrees.

8. A spray head as claimed in claim 1, comprising a further nozzle with a first boring and a second boring, the further nozzle being arranged in relation to said at least one nozzle so that said nozzles are placed one after the other regarding the passage.

9. A spray head as claimed in claim 8, wherein the further nozzle is directed at an angle, approximately 10 to 80 degrees in relation to the passage diverging in relation to said at least one nozzle.

10. A spray head as claimed in claim 1, wherein an air channel extends from an opening in the wall of the second boring to an exterior opening in the frame.

11. A spray head as claimed in claim 10, wherein the opening of the air channel is close to the transition between the second and the first boring.

12. A spray head as claimed in claim 1, wherein a channel extends from an opening in the wall of the second boring to an opening in the passage.

13. A spray head as claimed in claim 1 comprising a spindle slidably arranged in a main channel of the frame so that the spindle can slide from a first position where it closes the passage between the inlet and said nozzle to a second position where the passage between the inlet and the nozzle is open, wherein said borings are made into the spindle.

14. A spray head as claimed in claim 13, wherein said borings are made into the end of the spindle which faces away from the inlet.

15. A spray head as claimed in claim 14, wherein the spindle comprises a channel connecting the nozzle to the main channel.

16. A spray head as claimed in claim 13, comprising a further nozzle and the spindle being arranged to close a passage between the inlet and said further nozzle when the spindle is in the first position and to keep the passage between the inlet and the further nozzle open when the spindle is in the second position, the further nozzle being made into the frame and comprising borings with the same geometrical proportions as the borings of said at least one nozzle.

17. A spray head as claimed in claim 13, wherein the spindle comprises a piston-like part whose diameter corresponds with the diameter of the main channel.

18. A spray head as claimed in claim 17, comprising at least one through bore in the piston-like part of the spindle.

19. A spray head as claimed in claim 13 comprising a heat release means, wherein the spindle is arranged to be supported by the heat release means.

20. A spray head as claimed in claim 1 comprising a spindle slidably arranged in a main channel of the frame so that the spindle can slide from a first position where it closes the passage between the inlet and said nozzle to a second position where the passage between the inlet and the nozzle is open, wherein said borings are made into the frame.

21. A spray head as claimed in claim 20, comprising a further nozzle and the spindle being arranged to close the passage between the inlet and said further nozzle when the spindle is in the first position and to keep the passage between the inlet and the further nozzle open when the spindle is in the second position, the further nozzle being made into the spindle and comprising borings with corresponding geometrical proportions as the borings of said at least one nozzle.

22. A spray head as claimed in claim 21, wherein the borings in the further nozzle are made at the end of the spindle which faces away from the inlet.

23. A spray head as claimed in claim 22, wherein the spindle comprises a channel connecting the further nozzle at the end of the spindle to the main channel.

24. A spray head as claimed in claim 1, wherein the length of the second boring is greater than the length of the first boring.

* * * * *